US007784645B2

(12) United States Patent
Carta

(10) Patent No.: US 7,784,645 B2
(45) Date of Patent: Aug. 31, 2010

(54) CAP FOR CLOSING CONTAINERS

(75) Inventor: Lamberto Carta, Pescara (IT)

(73) Assignee: Emsar S.p.A., San Giovanni Teatino (CH) (IT)

( * ) Notice: Subject to any disclaimer, the term of this patent is extended or adjusted under 35 U.S.C. 154(b) by 9 days.

(21) Appl. No.: 12/306,864

(22) PCT Filed: Jun. 25, 2007

(86) PCT No.: PCT/IT2007/000447

§ 371 (c)(1),
(2), (4) Date: Dec. 29, 2008

(87) PCT Pub. No.: WO2008/001406

PCT Pub. Date: Jan. 3, 2008

(65) Prior Publication Data

US 2009/0277930 A1 Nov. 12, 2009

(30) Foreign Application Priority Data

Jun. 27, 2006 (IT) ..... RM2006A0336

(51) Int. Cl.
*B67B 1/00* (2006.01)

(52) U.S. Cl. ..... 222/153.01; 215/330

(58) Field of Classification Search ..... 222/153.01, 222/153.09, 153.1, 153.11; 215/330, 331, 215/263, 276, 295–395

See application file for complete search history.

(56) References Cited

U.S. PATENT DOCUMENTS

| | | | | |
|---|---|---|---|---|
| 4,746,035 | A * | 5/1988 | Anderson et al. | 222/153.06 |
| 5,356,043 | A | 10/1994 | Glynn | |
| 5,918,752 | A | 7/1999 | Meyer | |
| 6,367,641 | B1 * | 4/2002 | Garcia et al. | 215/330 |
| 6,772,914 | B2 * | 8/2004 | Hubmann et al. | 222/153.09 |
| 6,923,343 | B1 * | 8/2005 | Erxleben | 222/153.09 |

FOREIGN PATENT DOCUMENTS

| | | |
|---|---|---|
| FR | 2624482 | 6/1989 |
| JP | 11 278565 | 10/1999 |

OTHER PUBLICATIONS

International Search Report dated Nov. 22, 2007, in PCT application.

* cited by examiner

*Primary Examiner*—Lien T Ngo
(74) *Attorney, Agent, or Firm*—Young & Thompson

(57) ABSTRACT

A cap for closing containers includes a dispenser placed in connection with the interior of a container for dispensing a fluid contained in the container, a first sleeve integral with the dispenser and able to be screwed on the neck of the container to make the dispenser integral with the container. The cap further includes a second sleeve coaxial and surrounding the first sleeve and coupling elements active between the first and the second sleeve to couple mechanically the second sleeve to the first sleeve during a rotation of the second sleeve (7) in a first direction and to uncouple the second sleeve from the first sleeve during a rotation of the second sleeve in a second direction, opposite to the first. A covering element encompasses the dispenser and can be uncoupled from the cap coordinating a sequence of operations on the cap.

18 Claims, 5 Drawing Sheets

CAP FOR CLOSING CONTAINERS

TECHNICAL FIELD

The present invention relates to a cap for closing containers.

More in particular, the present invention relates to a "child proof" closing cap, i.e. a safety cap against accidental openings, for containers of liquids.

BACKGROUND ART

Known caps for closing a container are constituted by a ring nut, generally screwed on the neck of the container, bearing a dispenser that is placed in fluid communication with the interior of the container.

To prevent accidental dispensing of the fluid contained in the container, the dispenser is usually covered, and hence made inaccessible, by a covering element coupled to the ring nut.

The coupling between covering element and ring nut is such as to assure that the removal of the closing element can be effected only by performing a predetermined sequence of operations, e.g. rotations and/or pressures, on the covering element, as described for example in the document U.S. Pat. No. 5,356,043.

In this way, only a user who really wants to dispense the fluid contained in the container is able to remove the covering element, preventing the fluid from being spilled accidentally.

However, said closing caps of the prior art doe not prevent the ring nut from being unscrewed, e.g. accidentally by a child, from the neck of the container allowing direct access to its content.

Other closing caps are known that provide for fastening the ring nut to the neck of the container in nearly irremovable fashion, avoiding the aforementioned drawback.

Said fastening of the ring nut to the container neck is achieved providing a plurality of shoulders and undercuts which in fact set the ring nut to the container neck.

However, this second type of closing caps of the prior art requires particular sequences for mounting the ring nut on the container neck, which need automatic coupling systems that are highly complex and delicate.

Moreover, in this case, it is necessary to provide containers having particular neck conformations that necessarily increase production costs.

Additionally, it should be noted that the closing caps briefly described above can still be accidentally removed from the container if, for example, a child tries to force the coupling between ring nut and container neck.

DISCLOSURE OF THE INVENTION

In this context, the specific technical task of the present invention is to propose a cap for closing containers that is free of the drawbacks mentioned above.

In particular, an object of the present invention is to make available a cap for closing containers that is inviolably fastened to the neck of the container.

A further object of the present invention is to propose a cap for closing containers that allows only adults to access to the content of the container.

Yet another object of the present invention is to make available a cap for closing containers that allows an easy and economical automation of the process for coupling the cap to the container.

The technical task set out above and the specified objects are substantially achieved by a cap for closing containers comprising the technical characteristics exposed in one or more of the appended claims.

DESCRIPTION OF THE DRAWINGS

Further characteristics and advantages of the present invention shall become more readily apparent from the indicative, and therefore non limiting, description of a preferred but not exclusive embodiment of a cap for closing containers, as illustrated in the accompanying drawings in which.

DESCRIPTION OF THE ILLUSTRATIVE EMBODIMENT

Figure 1:
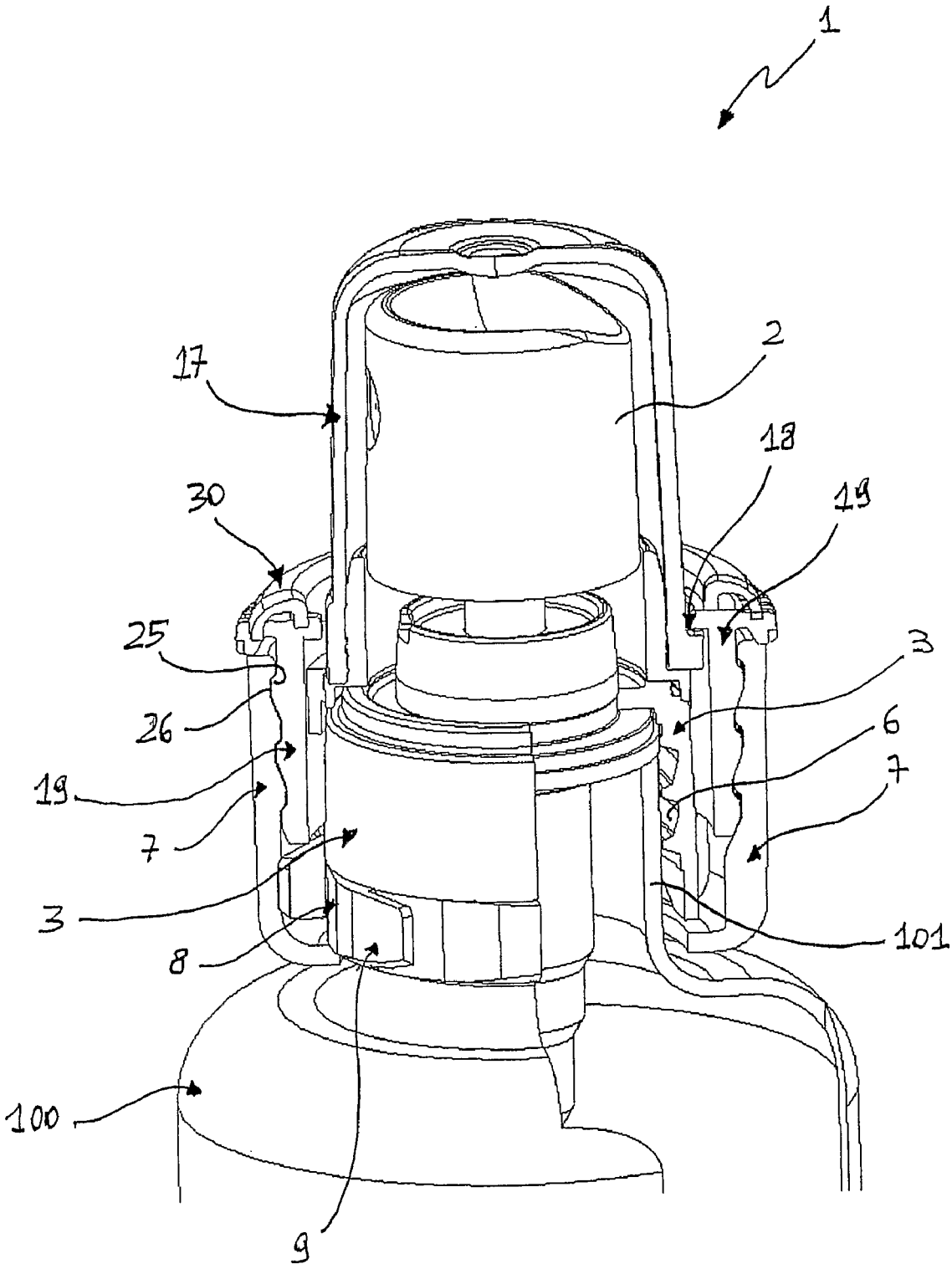
FIG. 1 is a perspective, partially sectioned view of a cap for closing containers according to the present invention.

With reference to FIG. 1, the number 1 indicates, in its entirety, a cap for closing containers according to the present invention.

The cap 1 is of the "child proof" type, i.e. it is a safety cap against accidental openings.

The cap 1 comprises a dispenser 2 placed in fluid connection with the interior of a container 100.

In the preferred embodiment illustrated in the accompanying drawings, the dispenser 2 is a pumping assembly, i.e. a micro-pump that draws fluid from the interior of the container 2 and makes it available for dispensing.

The dispenser 2 is integral with a first sleeve 3 which can be screwed to the neck 101 of the container 100.

Figure 2:
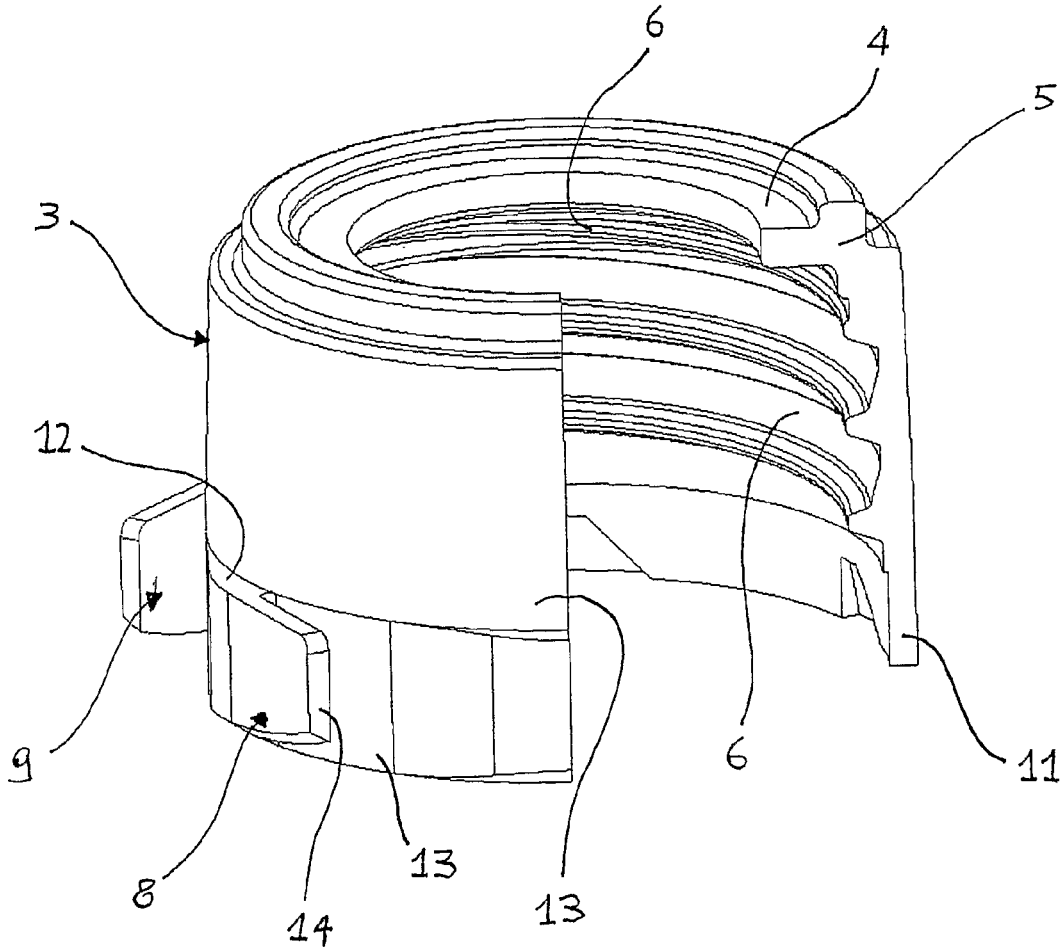
FIG. 2 is a perspective, partially sectioned view of a first detail of the cap of FIG. 1.

In particular, as shown in FIG. 2, the first sleeve 3 has substantially tubular shape and comprises a collar 4 positioned at a first end 5. The dispenser 2 is made integral with the collar 4 of the first sleeve 3 and develops away therefrom both towards the interior of the container 100 and in the opposite direction.

The first sleeve 3 has a threaded inner surface 6 which is screwed on a corresponding thread (not shown) present on the neck 101 of the container 100, in such a way as to make integral both the first sleeve 3 and the dispenser 2 with the container 100.

It should be stressed that the threading present on the inner surface 6 of the first sleeve 3 can have any pitch and any number of threads, depending on the type of threading present on the neck 101 of the container 100.

In other words, for every type of container it is possible to choose a corresponding first sleeve 3 having appropriate dimensions and threading.

Advantageously, the cap 1 comprises a second sleeve 7, coaxial and completely encompassing the first sleeve 3 and coupling means 8 active between the first 3 and the second sleeve 7, to couple mechanically the second sleeve 7 to the first sleeve 3 during a rotation of the second sleeve 7 in a first direction and uncouple the second sleeve 7 from the first sleeve 3 during a rotation of the second sleeve 7 in a second direction, opposite the first.

In this way, rotating the second sleeve 7 on the first sleeve 3 clockwise, the coupling means 8 make the two sleeves integral, allowing the first sleeve to be screwed onto the neck 101 of the container 100, whilst rotating the second sleeve 7 counter-clockwise, the coupling means 8 uncouple the two sleeves and prevent the first sleeve 3 from unscrewing from the neck 101 of the container 100, assuring that the cap 1 is inviolably fastened to the container 100.

In particular, the coupling means 8 comprise a plurality of fins 9 positioned on the first sleeve 3 and a plurality of projections 10 positioned on the second sleeve and facing the fins 9.

More in particular, as shown in FIG. 2, the fins 9 are positioned on the first sleeve 3, at a second end 11 opposite to the first end 5, and they comprise a first portion 12 directly fastened to the outer surface 13 of the first sleeve 3 and a second portion 14 that develops away from the outer surface 13.

The direction of development of the second portion 14 of the fins 9 defines, in combination with the tangent to the outer surface 13 of the first sleeve 3, an acute angle, in such a way that the second portions 14 of the fins 9 are oriented in the opposite direction of rotation from the one necessary to screw the first sleeve 3 on the neck 101 of the container 100.

Figure 3:
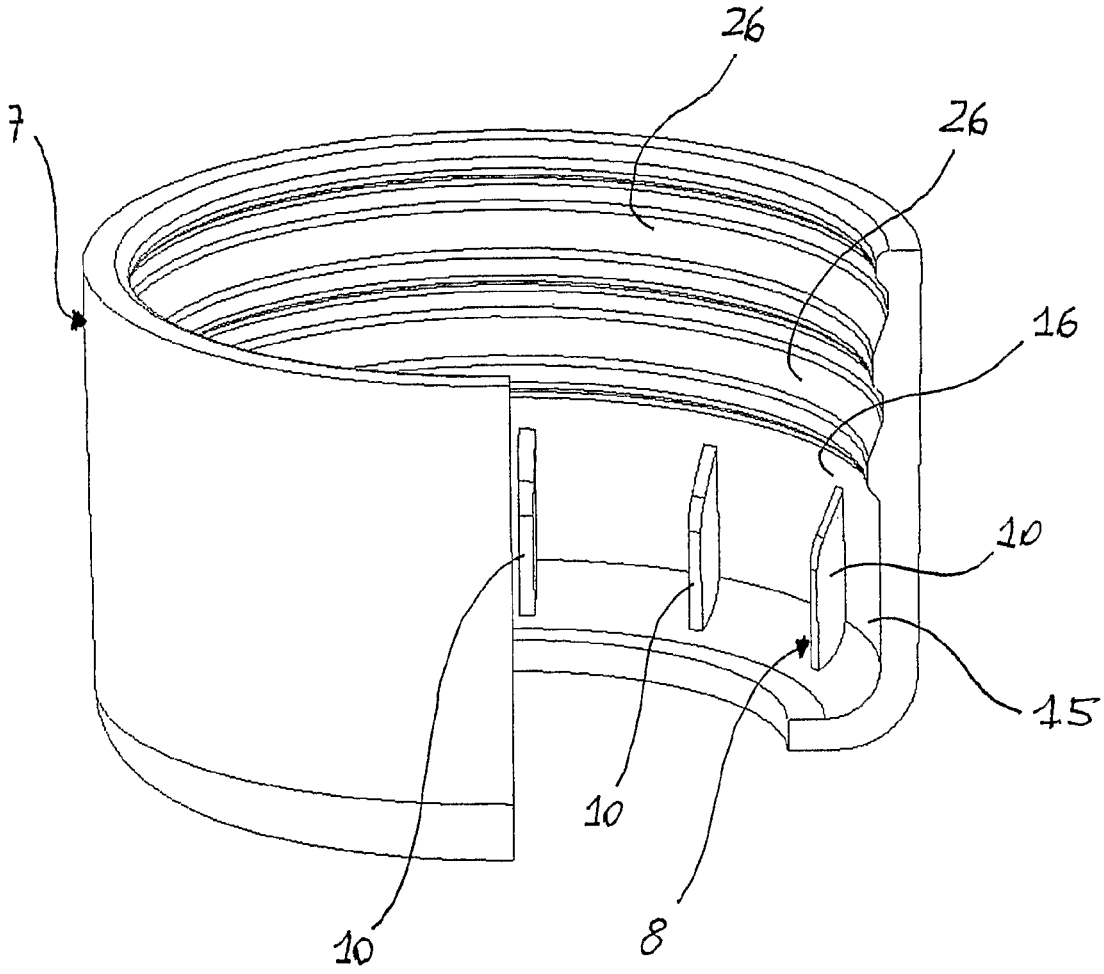
FIG. 3 is a perspective, partially sectioned view of a second detail of the cap of FIG. 1.

With particular reference to FIG. 3, the projections 10 of the coupling means 8 are positioned in a lower portion 15 of the second sleeve 7, which has substantially tubular conformation.

The projections 10 emerge from the inner surface 16 of the second sleeve 7, face the fins 9 and are intended to engage and retain the second portions 14 of the fins 9 when the second sleeve 7 is rotated to screw the first sleeve 3 on the neck 101 of the container 100.

Rotating the second sleeve in the direction opposite the direction of screwing, the second portions 14 of the fins 9 slide on the projections 10 preventing the mutual coupling between first 3 and second sleeve 7.

Figure 4:
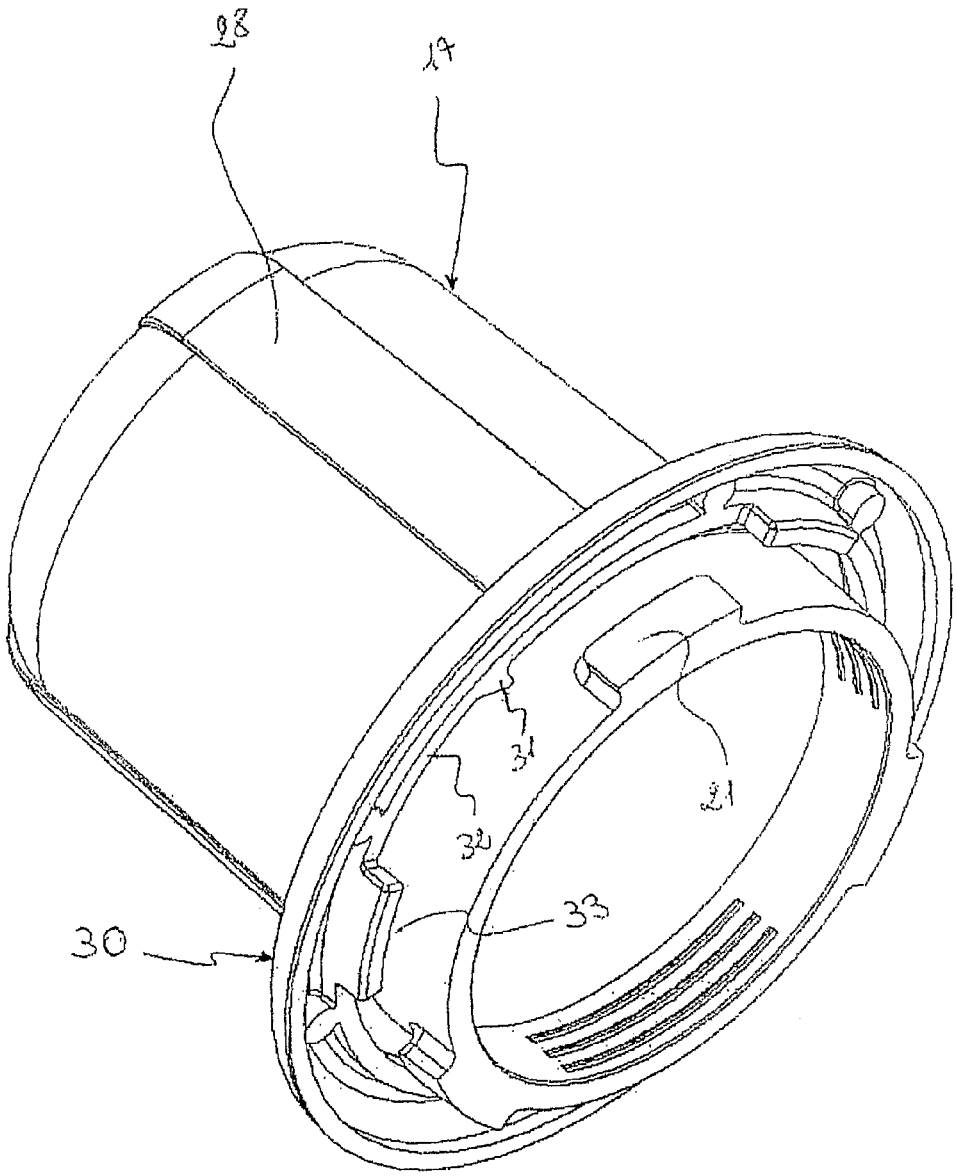
FIG. 4 is a perspective, partially sectioned view of a third detail of the cap of FIG. 1.

The cap 1 further comprises a covering element 17 of the dispenser 2, to prevent an involuntary activation of the dispenser 2, as illustrated in FIGS. 1 and 4.

The covering element 17 completely surrounds and encloses the dispenser 2 and it is retained thereon by retaining means 18.

Said retaining means 18 comprise a third sleeve 19, coaxial and longitudinally fastened to the first two sleeves.

Figure 5:
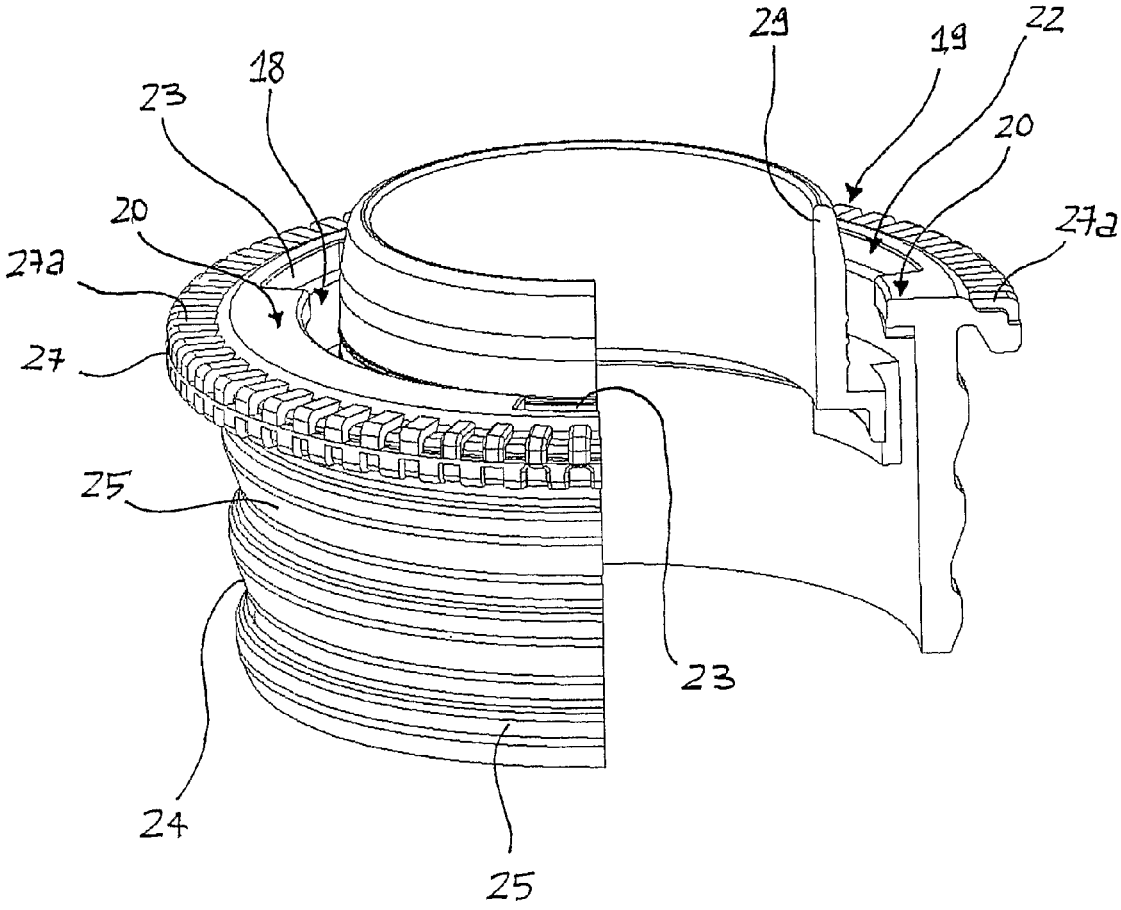
FIG. 5 is a perspective, partially sectioned view of a fourth detail of the cap of FIG. 1.

With particular reference to FIGS. 1 and 5, the third sleeve 19 is substantially tubular and comprises, at a first end 18, an annular shoulder 20 that retains at least one appendage 21 of the covering element 17 positioned at one end thereof.

The sleeve 1 further comprises means 22 for releasing the covering element 17 to allow its disengagement from the third sleeve 19.

In particular, said release means 22 comprise at least one opening 23 obtained in the annular shoulder 20 of the third sleeve 19 for the passage of the appendage 21 of the covering element 17.

In this way, aligning the appendage 21, whereof in the preferred embodiment there are three, equidistant at 120° from each other, with the opening 23, whereof in the preferred embodiment there are three, equidistant at 120° from each other, it is possible to disengage the covering element 17 from the third sleeve 19.

For this regard, the third sleeve 19 is rotatably coupled to the second sleeve 17.

In particular, in the preferred embodiment, the third sleeve 19 comprises a first portion 24 which presents an outer surface having a succession of circumferential projections and recesses 25, i.e. a development that is perpendicular to the axis of rotation of the third sleeve 19.

Said third sleeve is engaged with the inner surface 16 of the second sleeve 7, as shown in FIG. 1, in a region that is not involved by the projections 10 of the coupling means 8 (see FIG. 3), which presents a corresponding succession of circumferential projections and recesses 26.

The two successions of projections and recesses 25, 26 mutually engage allowing the rotation of the third sleeve 19 relative to the second sleeve 7, and preventing the longitudinal sliding, i.e. in a direction parallel to the axis of rotation of the third sleeve 19, of the two sleeves.

In this way, the third sleeve 19 is freely rotatable relative to the container 100 and it is longitudinally fastened thereto.

The third sleeve 19 further comprises a second portion 27, emerging with respect to the second sleeve 7, to operate the rotation of the sleeve itself.

This second portion 27, visible in FIGS. 1 and 5, comprises a knurled area 27*a*, which can be gripped by a user to facilitate handling the third sleeve 19.

According to the above description, to remove the covering element 17 from the cap 1 and hence access the dispenser 2, it is necessary to effect a relative rotation between the covering element 17 and the third sleeve 19, until the appendages 21 align with the opening 23 of the annular shoulder 20 and, subsequently, pull the covering element 17 upwards to make the appendages 21 exit the openings 23.

In this way, advantageously, the covering element 17 can be removed only voluntarily and co-ordinating a series of operations, hence excluding that the dispenser 2 may accidentally dispense the liquid contained in the container 100 or that a child may access the dispenser 2.

It should also be noted that the covering element 17 comprises three ribs 28, whereof one is visible in FIG. 4, positioned at the appendages 21, to easily identify the their position.

The covering element 17 is reinserted repeating the above described steps in reversed order.

To facilitate the reinsertion of the covering element 17 on the dispenser 2, the third sleeve 19 comprises a guiding portion 19 with tubular shape and tapered in the direction of the covering element 17.

The cap 1 further comprises a seal 30 integral with the covering element 17, removable as a result of a first opening of the covering element 17.

The seal 30, shown in FIG. 4, has substantially annular shape and surrounds the lower portion of the covering element 17.

The seal 30 is made integral to the covering element 17 by means of one or more spokes 31 present on an annular portion 32 of the seal 30.

This annular portion 32 of the seal 30 further comprises at least one appendage 33 insertable into the opening 23 of the annular shoulder 30 of the third sleeve 19, in such a way as to prevent the rotation of the third sleeve 19 relative to the closing element 17, thus denying access to the dispenser 2.

The spokes 31 are connected to the covering element 17 by a relatively thin strip of material, to enable the spokes to break and hence detach from the annular portion 32 of the seal 30 as a result of the first opening of the covering element 17.

The appendage 33 opposes the mutual rotation between the third sleeve 19 and the covering element 17. Forcing the rotation thereof relative to the third sleeve 19, the spokes 31 are broken, letting the system rotate freely and removing the covering element 17.

Upon even a cursory visual examination of the seal 30, it is then immediately observable that the covering element 17 has already been removed once.

The invention achieves the proposed objects.

The cap for closing containers of the present invention is fastened in practically inviolable fashion to the neck of the container thanks to the first sleeve, to the second sleeve and to the coupling means operating between the two.

Moreover, the closing element and the third sleeve allow access to the content of the container only to adult persons, because it is necessary to co-ordinate a series of operations to be able to remove the closing element.

Additionally, the fact that the cap is applied to the neck of the container by simple screwing allows for an easy and economical automation of the process of coupling the cap to the container.

The invention claimed is:

1. A cap for closing containers comprising:

a dispenser placed in connection with the interior of a recipient to dispense a fluid contained in the container;

a first sleeve integral with the dispenser and able to be screwed on the neck of the container to make the dispenser integral with the container;

a second sleeve coaxial to and encompassing the first sleeve and coupling means active between the first sleeve and the second sleeve to couple the second sleeve mechanically to the first sleeve during a rotation of the second sleeve in a first direction and uncouple the second sleeve from the first sleeve during a rotation of the second sleeve in a second direction opposite to the first direction;

a covering element for said dispenser comprising retaining means for retaining said covering element on said dispenser wherein said retaining means comprise a third sleeve that is coaxial and longitudinally fastened to the first two sleeves; said third sleeve comprising an annular shoulder to abut and retain at least one appendage of said covering element.

2. A cap as claimed in claim 1, wherein said coupling means comprise a plurality of fins positioned on the first sleeve which develop tangentially away from the first sleeve towards the second sleeve and a plurality of projections positioned on the second sleeve and facing said fins to retain said fins during the rotation of the second sleeve in said first direction and to release said fins during the rotation of the second sleeve in said second direction.

3. A cap as claimed in claim 2, wherein said fins comprise a first portion directly fastened to an outer surface of the first sleeve and a second portion that develops away from said outer surface of the first sleeve; said second portion developing away from the first sleeve along a direction forming an acute angle with the outer surface of the sleeve, to slide on the projections of the second sleeve during the rotation of the second sleeve in the second direction and to intercept and interfere with the projections of the second sleeve during the rotation of said second sleeve in the first direction.

4. A cap as claimed in claim 1 wherein said second sleeve completely surrounds said first sleeve presenting a greater longitudinal development than the longitudinal development of the first sleeve.

5. A cap as claimed in claim 1 comprising means for releasing said covering element to disengage said appendage of the covering element from the annular shoulder of the third sleeve.

6. A cap as claimed in claim 5 wherein said annular shoulder comprises at least one opening for the passage of said appendage of the covering element; said third sleeve being rotatable coaxially to said covering element to align said opening to said appendage.

7. A cap as claimed in claim 6 wherein said covering element comprises at least one rib at each appendage, to indicate the position of each appendage.

8. A cap as claimed in claim 6 wherein said appendages are three, equidistant at 120° from each other; said opening being three, equidistant at 120° from each other.

9. A cap as claimed in claim 6 wherein said third sleeve comprises a first portion for engagement with said second sleeve and a second control portion, integral with the first sleeve, to control its rotation.

10. A cap as claimed in claim 9 wherein said first portion of the third sleeve has an outer surface comprising a succession of circumferential recesses and projections facing a corresponding succession of projections and recessions positioned on an inner surface of the second sleeve, to fasten longitudinally the third sleeve to the second sleeve.

11. A cap as claimed in claim 10 wherein said successions of circumferential projections and recesses develop perpendicularly to an axis of rotation of the third sleeve, to make the third sleeve relative to the second sleeve.

12. A cap as claimed in claim 9 wherein said second portion of the third sleeve comprises a knurled area which can be gripped by a user to rotate the third sleeve.

13. A cap as claimed in claim 6 comprising a seal integral with the covering element removable as a result of a first opening of the covering element.

14. A cap as claimed in claim 13 wherein said seal comprises a plurality of spokes integral with the covering element and at least one appendage insertable in said opening of the annular shoulder of the third sleeve; said spokes breaking as a result of the first opening of the covering element to release the covering element.

15. A cap as claimed in claim 6 wherein said third sleeve comprises a guiding portion for the reinsertion of the covering element; said guiding portion being radially internal relative to said annular shoulder.

16. A cap as claimed in claim 1 wherein the cap is axial-symmetrical.

17. A cap as claimed in claim 1 comprising a seal integral with the covering element removable as a result of a first opening of the covering element.

18. A cap for closing containers comprising:

a dispenser placed in connection with the interior of a recipient to dispense a fluid contained in the container;

a first sleeve integral with the dispenser and able to be screwed on the neck of the container to make the dispenser integral with the container;

a second sleeve coaxial to and encompassing the first sleeve and coupling means active between the first sleeve and the second sleeve to couple the second sleeve mechanically to the first sleeve during a rotation of the second sleeve in a first direction and uncouple the second sleeve from the first sleeve during a rotation of the second sleeve in a second direction opposite to the first direction; and a covering element for said dispenser and a seal integral with the covering element removable as a result of a first opening of the covering element.

* * * * *